United States Patent [19]

Carter et al.

[11] Patent Number: 4,490,955

[45] Date of Patent: Jan. 1, 1985

[54] RESIDENTIAL WALL CONSTRUCTION

[75] Inventors: Neil A. Carter, Reynoldsburg; Richard A. Mott, Alexandria, both of Ohio

[73] Assignee: Owens-Corning Fiberglas Corporation, Toledo, Ohio

[21] Appl. No.: 401,202

[22] Filed: Jul. 23, 1982

[51] Int. Cl.[3] ..... E04C 1/04

[52] U.S. Cl. ..... 52/30.14; 52/375; 52/404; 52/508

[58] Field of Search ..... 52/404–407, 52/410, 144, 375, 659, 508, 509, 403, 309.14, 602

[56] References Cited

U.S. PATENT DOCUMENTS

| | | | |
|---|---|---|---|
| 1,634,283 | 7/1927 | Birkholz | 52/508 |
| 2,040,350 | 5/1936 | Wernette | 52/375 |
| 2,092,752 | 9/1937 | Davis | 52/602 |
| 2,164,322 | 7/1939 | Hahn | 52/375 |
| 2,742,115 | 4/1956 | Strong | 52/403 |
| 3,531,901 | 10/1970 | Will et al. | 52/404 |
| 3,581,453 | 6/1971 | Jones et al. | 52/144 |
| 3,953,953 | 5/1976 | Marsden | 52/659 |
| 4,000,594 | 1/1977 | Kirk | 52/241 |
| 4,224,774 | 9/1980 | Petersen | 52/309.14 |
| 4,385,477 | 5/1983 | Walls et al. | 52/404 |

*Primary Examiner*—James L. Ridgill, Jr.

*Attorney, Agent, or Firm*—Ronald C. Hudgens; Ted C. Gillespie; Paul J. Rose

[57] ABSTRACT

The wall construction includes elongated molded fibrous channels secured together in side-by-side relationship and pairs of structural fastening strips secured to the channels, each joint between two adjacent channels having a pair of the structural fastening strips extending along the joint respectively adjacent opposite ends of leg portions of the channels.

18 Claims, 8 Drawing Figures

RESIDENTIAL WALL CONSTRUCTION

TECHNICAL FIELD

This invention relates generally to residential wall constructions, and more particularly to residential wall constructions including molded fibrous channels with reinforcing strips at joints.

BACKGROUND ART

U.S. Pat. No. 2,742,115 discloses glass fibers molded into channels, the channels being encased in evacuated metal casings bolted together to form walls.

U.S. Pat. No. 3,531,901 discloses molded glass wool stud or joist members with metal caps.

U.S. Pat. No. 4,000,594 discloses gypsum board channels in wall and ceiling constructions.

U.S. Pat. No. 4,224,774 discloses studs of molded glass sandwiched between wood reinforcing strips.

DISCLOSURE OF THE INVENTION

In accordance with the invention, fibrous material and a binder are molded to produce channels, the channels are adhered together side-by-side, and structural fastening strips, preferably wood, are provided at the joints. The channels are preferably filled with insulation, and siding may be applied on the outside and drywall or gypsum board may be applied on the inside to complete a wall. In certain embodiments, either the drywall or the siding may be omitted. The leg portions of the channels are cut away at the top and bottom of the wall to receive a top plate and a sill plate, respectively, the top and sill plates being molded fibrous material sandwiched between wood strips.

BRIEF DESCRIPTION OF DRAWINGS

The invention is hereinafter described more specifically with reference to the accompanying drawings in which.

BEST MODE OF CARRYING OUT THE INVENTION

Figure 1:
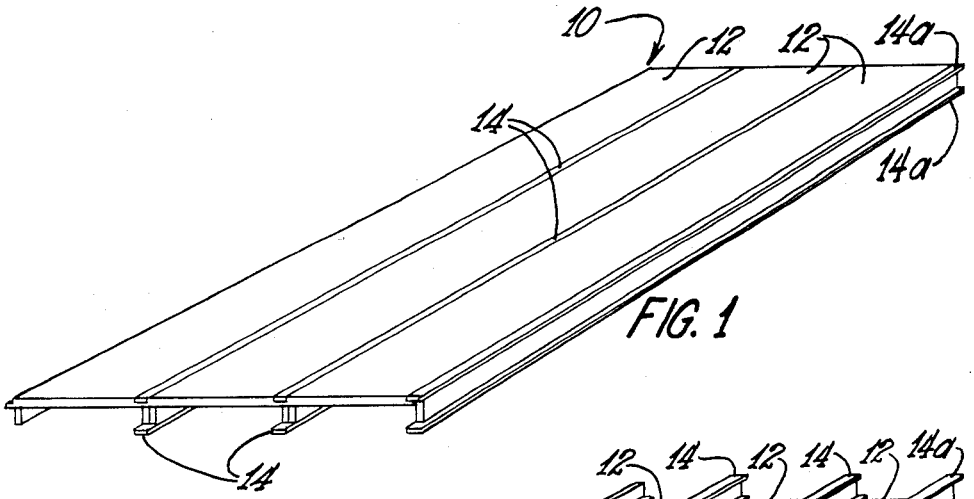
FIG. 1 is a perspective view of a structural wall panel constructed in accordance with the invention.

With reference to the drawings, FIG. 1 shows a structural wall panel 10 constructed in accordance with the invention and including three parallel, identically oriented channels 12 in side-by-side relationship adhered together at adjacent leg portions with suitable elastomeric adhesive and four structural fastening strips 14, preferably wood, two on each side of the panel respectively at the joints between channels. Additionally, two wood strips **14*a*, identical in size to the wood strips 14, are provided respectively on opposite sides of the panel adjacent one edge. The wood strips 14*a* may be installed at the factory or at the building site where the panel is used. The panel 10 may be made with a different number of channels 12. The same kind of adhesive as used to secure the channels together may be used to secure the wood strips to the channels. To enable handling of the panel 10 without waiting for the adhesive to set, opposite wood strips 14 are stapled together through the leg portions of the channels. Preferably, the channels 12 are contoured on the outer surfaces of the bottom portions for flush reception of the wood strips 14 at the joints. The channels 12 are molded from fibrous glass, mineral, or slag wool with 13 to 20 percent binder to a density of six to 20 pounds per cubic foot. Molded fibrous glass with 20 percent phenol-formaldehyde type binder by weight and a density of 13 pounds per cubic foot has been found satisfactory. The wood strips are of any suitable building lumber such as spruce, pine, or fir. As an example, the panel 10 may be four feet by eight feet by four and three-quarters inches. The channels 12 may be 16 or 24 inches wide, depending on whether there are two or three, with a molded glass wool thickness of three-fourths of an inch at the channel bottom portions and the leg portions and may contain insulation four inches thick. The wood strips 14** may be one-half by one and one-half inches in cross section. The leg portions of the channels may be made longer if additional wall thickness is desired to provide space for more than four inches of insulation.

Figure 2:
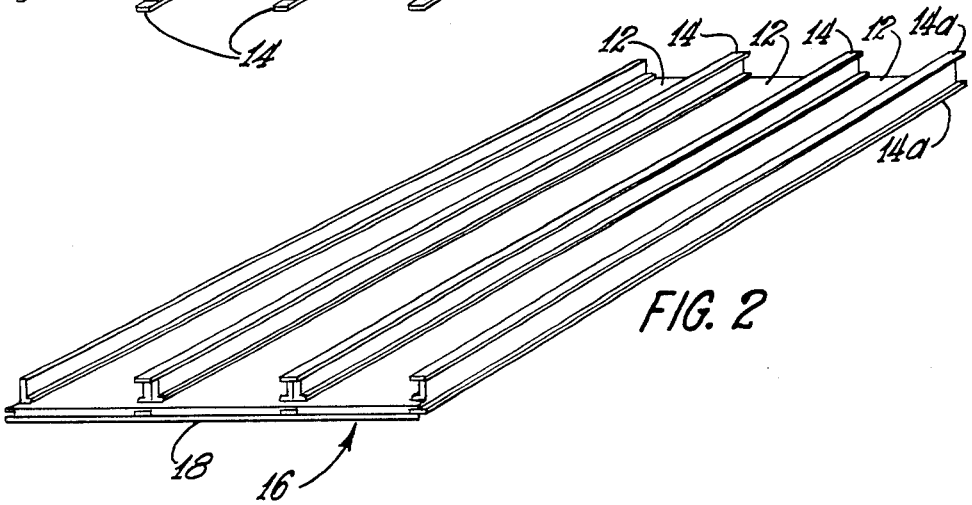
FIG. 2 is a perspective view of another embodiment of a wall panel constructed in accordance with the invention.
Figure 3:
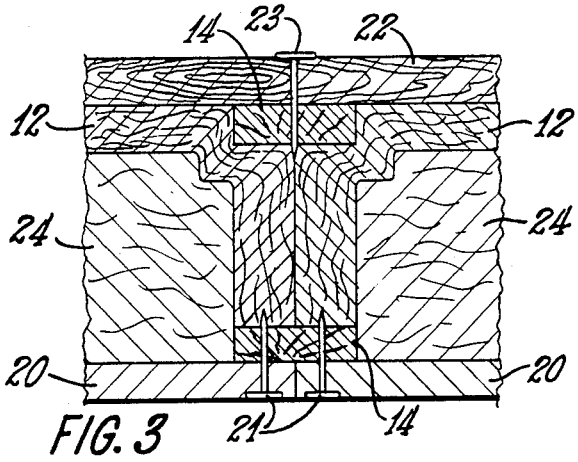
FIG. 3 is a fragmentary horizontal sectional view of a wall constructed in accordance with the invention.
Figures 4, 5, 6, 7:
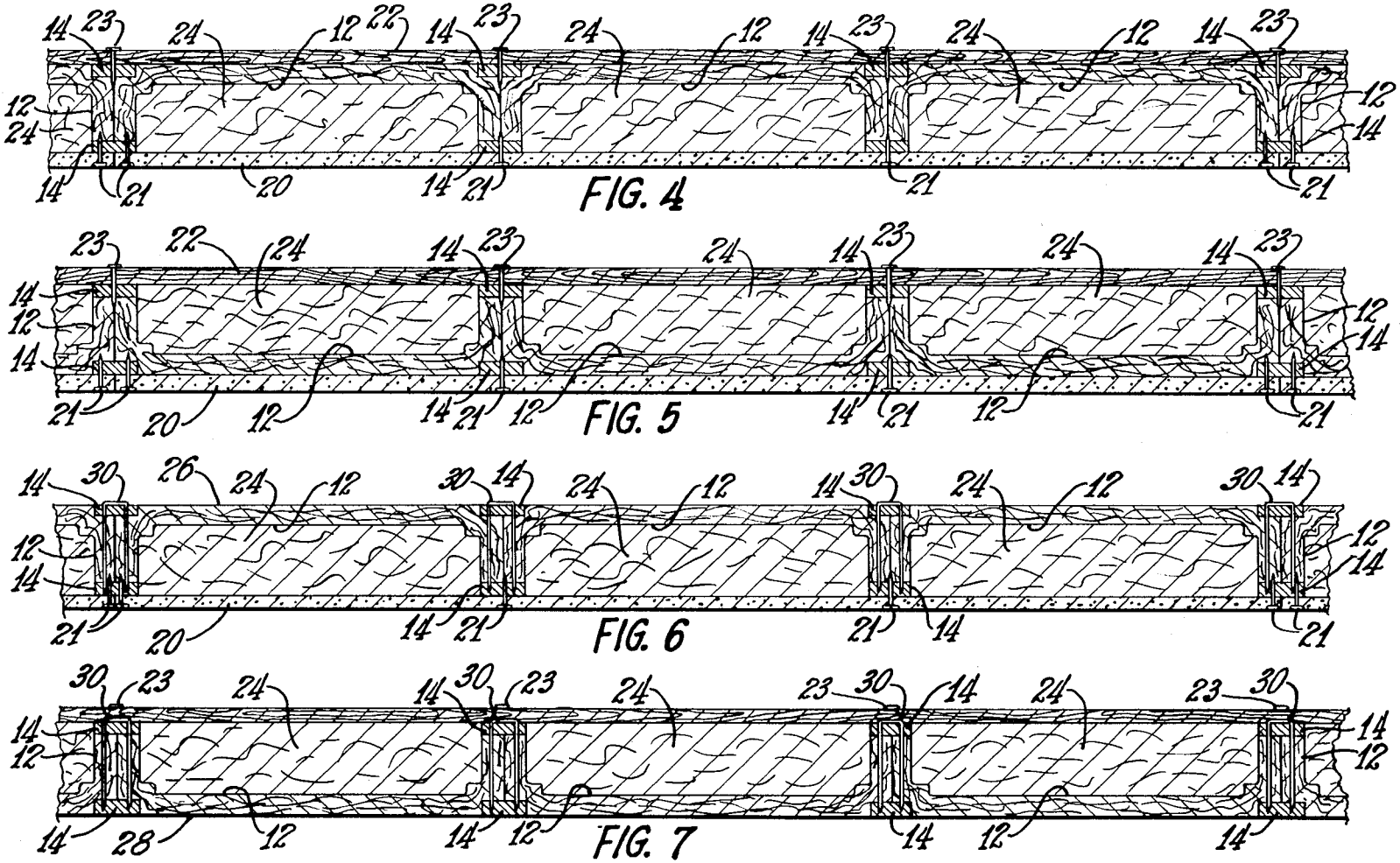
FIG. 4 is a view similar to FIG. 3, but showing a longer length of the wall on a smaller scale.
FIG. 5 is a fragmentary horizontal sectional view of another wall constructed in accordance with the invention.
FIG. 6 is a fragmentary horizontal sectional view of another wall constructed in accordance with the invention.
FIG. 7 is a fragmentary horizontal sectional view of another wall constructed in accordance with the invention.

FIG. 2 shows a panel 16 identical to the panel 10 except for an additional sheet 18 which may be a suitable siding material for outside exposure or a suitable drywall material for inside exposure. It is within the scope of the invention to construct three-channel panels such as the panels 10 and 16 from the channels 12 and wood strips 14 and to use the panels in further construction. It is also within the scope of the invention to assemble larger numbers of the channels 12 and wood strips 14 to partially form wall lengths as long as the full length or width of a house with appropriate cutouts for windows and doors. Further, it is also within the scope of the invention to construct more nearly complete structures, such as by assembling insulation, siding, and gypsum board or drywall with the channels 12 and wood strips 14, either in a factory or at a building site. FIGS. 3 and 4 are fragmentary horizontal sectional views of a wall structure which can be considered as having been built up either from three-channel panels or from a larger number of separate channels 12. A plurality of channels 12 may be adhered together in side-by-side relationship and pairs of wood strips 14 applied at the joints. Drywall 20 is then nailed with nails 21 to the strips 14 at the free end portions of the leg portions of the channels 12 for inside exposure and siding 22 is nailed with nails 23 to the opposite strips 14 at the base of the leg portions of the channels 12 for outside exposure. The channels 12 are preferably filled with insulation material 24 before application of the drywall 20. The insulation 24 is preferably glass fiber blanket material. The wood strips 14 act as nailing or fastening strips and also as flanges of an I-beam to provide bending and compression strength. Generically, therefore, the strips 14 are structural fastening strips. It is within the scope of the invention to use appropriate metal or reinforced plastic strips in place of the wood strips 14 and to use screws in place of the nails 21 and 23. Further, the channels 12 may be manufactured as generally flat sheets, provided with grooves, and folded up at the edges to provide the general shape of a channel.

FIG. 5 shows a wall construction similar to FIG. 4 but with the channels 12 reversed to enable installation of the insulation 24 from the outside of a house before application of the siding 22.

FIG. 6 shows a wall construction similar to FIG. 4 but with the siding 22 replaced by a layer of vinyl plastic 26 molded simultaneously with the channels 12. The outer wood strips 14 are provided with a protective coating when no siding 22 is used.

FIG. 7 shows a wall construction similar to FIG. 5 but with the drywall 20 replaced by suitable wallpaper 28.

In each of the wall structures of FIGS. 4–7, the pairs of opposite wood strips 14 at the joints between adjacent channels 12 are stapled together through the leg portions of the channels by a plurality of staples 30, omitted in FIGS. 4 and 5 but shown in FIGS. 6 and 7.

Figure 8:
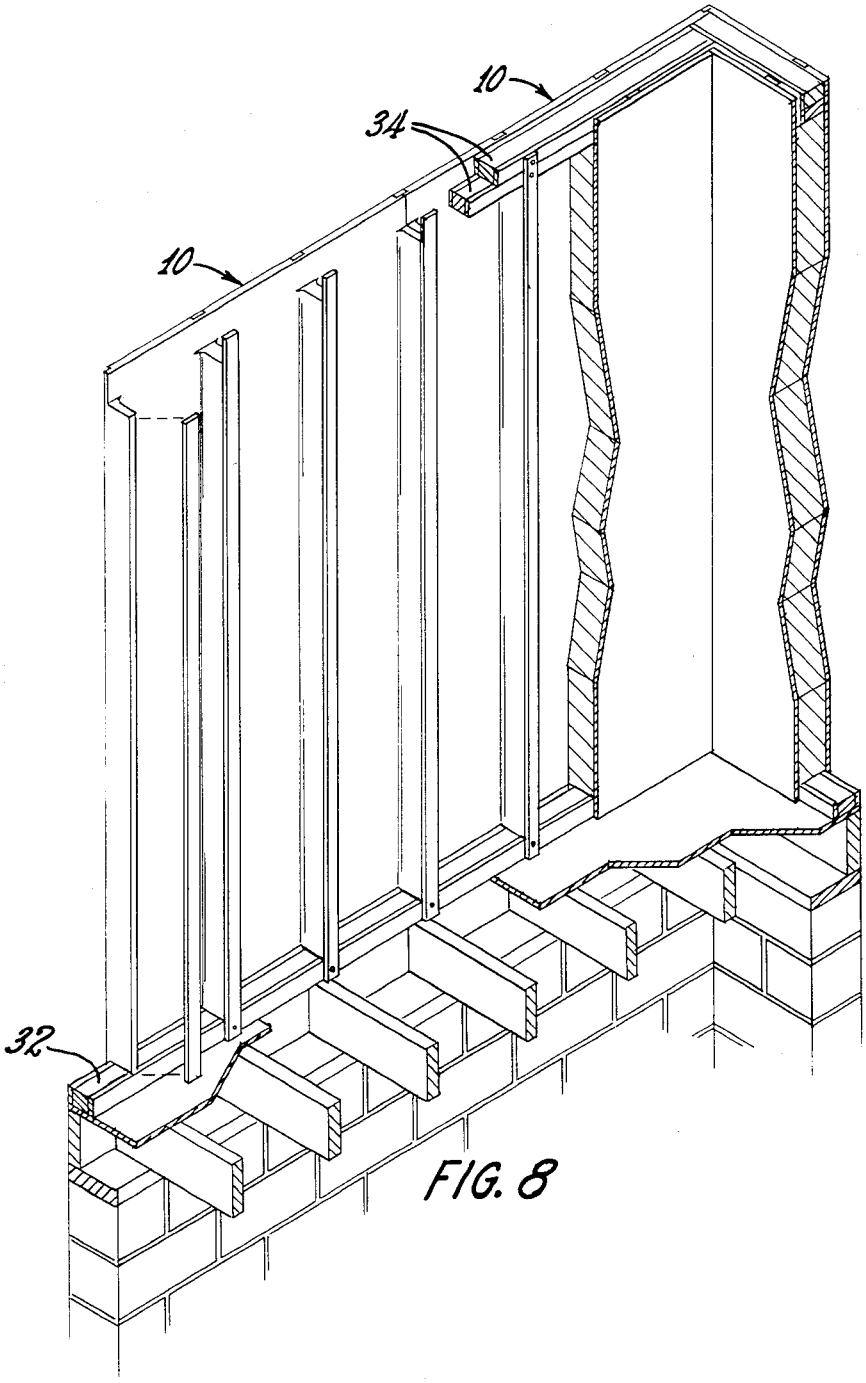
FIG. 8 is a fragmentary perspective view illustrating initial stages of construction of the walls of FIGS. 4 and 6.

FIG. 8 shows how the leg portions of the channels 12 are cut away at the bottom of a wall to receive a sill plate 32 and at the top of the wall to receive a pair of top plates 34 substantially identical to the sill plate 32.

The plates 32 and 34 preferably are composed of a molded fibrous core of the same material as the channels 12 sandwiched between a pair of wood strips.

Each of the wall constructions of FIGS. 4–7 may be provided with door and window openings framed by members of sandwich construction like that of the plates 32 and 34.

Some advantages of the proposed wall constructions are less air infiltration, improved thermal and acoustical insulation, and less susceptibility to damage by moisture, mice, and termites in the molded glass wool portions.

Various modifications may be made in the structure shown and described without departing from the spirit and scope of the invention.

We claim:

1. A wall construction comprising identically oriented elongated molded fibrous channels secured together in side-by-side relationship and pairs of elongated structural fastening strips secured to the channels, each joint between two adjacent channels having a pair of the structural fastening strips extending along the joint, one of the strips of each pair being disposed adjacent outer surfaces of bottom portions of the channels and the other of the strips of each pair being disposed adjacent free ends of leg portions of the channels, the channels being molded of glass, mineral, or slag wool with a resin binder, having a density of less than twenty pounds per cubic foot, and by themselves having insufficient bending and compression strength for use as a sole structural component of a wall, and the structural fastening strips providing additional bending and compression strength whereby the wall construction including the channels and the structural fastening strips does have sufficient bending and compression strength for use as the sole structural component of a wall.

2. A wall construction as claimed in claim 1 wherein the one of the structural fastening strips of each pair disposed adjacent outer surfaces of bottom portions of the channels is recessed within the two channels so as to be flush with the outer surfaces of bottom portions of the channels, the channels having been molded with suitable recesses for receiving the one structural fastening strip.

3. A wall construction as claimed in claim 1 wherein the channels are fibrous glass molded with a resin binder and have a density less than fifteen pounds per cubic foot.

4. A wall construction as claimed in claim 1 wherein the channels are fibrous glass molded with a resin binder, the binder being present in an amount less than twenty-five percent by weight.

5. A wall construction as claimed in claim 1 wherein the channels are secured together with elastomeric adhesive and the structural fastening strips are adhered to the channels with elastomeric adhesive.

6. A wall construction as claimed in claim 5 wherein the structural fastening strips at each joint between adjacent channels are wood and are stapled together through the leg portions of the channels.

7. A wall construction as claimed in claim 1 wherein the structural fastening strips are wood and including siding nailed to the wood strips at free end portions of the leg portions of the channels.

8. A wall construction as claimed in claim 7 including insulation filling the channels.

9. A wall construction as claimed in claim 8 wherein the insulation is fibrous glass insulation.

10. A wall construction as claimed in claim 1 wherein the structural fastening strips are wood and including drywall nailed to the wood strips at free end portions of the leg portions of the channels.

11. A wall construction as claimed in claim 10 including insulation filling the channels.

12. A wall construction as claimed in claim 11 wherein the insulation is fibrous glass insulation.

13. A wall construction as claimed in claim 1 wherein the structural fastening strips are wood and including siding nailed to the wood strips at free end portions of the leg portions of the channels and drywall nailed to the wood strips adjacent bottom portions of the channels.

14. A wall construction as claimed in claim 13 including insulation filling the channels.

15. A wall construction as claimed in claim 14 wherein the insulation is fibrous glass insulation.

16. A wall construction as claimed in claim 1 wherein the structural fastening strips are wood and including drywall nailed to the wood strips at free end portions of the leg portions of the channels and siding nailed to the wood strips adjacent bottom portions of the channels.

17. A wall construction as claimed in claim 16 including insulation filling the channels.

18. A wall construction as claimed in claim 17 wherein the insulation is fibrous glass insulation.

* * * * *